US012384589B2

(12) United States Patent
Arregui Letamendi

(10) Patent No.: US 12,384,589 B2
(45) Date of Patent: Aug. 12, 2025

(54) BOTTLE WITH A CUT MOUTH

(71) Applicant: DSIGNTANK S.L., Barcelona (ES)

(72) Inventor: Jokin Arregui Letamendi, Barcelona (ES)

(73) Assignee: DSIGNTANK S.L., Barcelona (ES)

( * ) Notice: Subject to any disclaimer, the term of this patent is extended or adjusted under 35 U.S.C. 154(b) by 334 days.

(21) Appl. No.: 17/440,018

(22) PCT Filed: Mar. 13, 2020

(86) PCT No.: PCT/ES2020/070182

§ 371 (c)(1),
(2) Date: Sep. 16, 2021

(87) PCT Pub. No.: WO2020/201595

PCT Pub. Date: Oct. 8, 2020

(65) Prior Publication Data

US 2022/0169413 A1 Jun. 2, 2022

(30) Foreign Application Priority Data

Mar. 29, 2019 (ES) ..... ES201930512U

(51) Int. Cl.
*B65D 1/02* (2006.01)

(52) U.S. Cl.
CPC ..... *B65D 1/023* (2013.01)

(58) Field of Classification Search
CPC ..... B65D 1/023
(Continued)

(56) References Cited

U.S. PATENT DOCUMENTS 2,334,851 A * 11/1943 Waite ..... B65D 47/061 222/522
2,914,207 A * 11/1959 Moore ..... B65D 39/0023 215/45

(Continued)

FOREIGN PATENT DOCUMENTS

| | | | |
|---|---|---|---|
| AU | 2017310041 | A1 | 2/2019 |
| DE | 202014104284 | U1 | 12/2015 |
| WO | 2014053212 | A1 | 4/2014 |

OTHER PUBLICATIONS

International Search Report, PCT/ES2020/070182, Mailed Sep. 14, 2020.

*Primary Examiner* — Ernesto A Grano
(74) *Attorney, Agent, or Firm* — Calderone McKay, LLC

(57) ABSTRACT

The object of the present invention relates to a bottle or a container with a cut mouth which can be conveyed or held in automated industrial processes, having at least one groove or recess arranged at the inflection point between the body of the bottle and the neck thereof. The at least one groove is preferably a groove with a concave cross-section with curved profiles running along the perimeter and at one and the same level in the neck of the bottle or container and at the inflection point between the body of the bottle and the neck, which requires means by way of a grip or overhang being arranged whereby allowing them to be held and/or conveyed, both of which are essential actions in the automated industrial processes such as traveling from the starting mould to the finisher, the positioning in the finishing mould, the removal of the bottle from the finishing mould, etc.

5 Claims, 4 Drawing Sheets

(58) Field of Classification Search
USPC ..... 215/40
See application file for complete search history.

(56) References Cited

U.S. PATENT DOCUMENTS

| | | | | | |
|---|---|---|---|---|---|
| 3,212,663 | A * | 10/1965 | Greenwell | B65D 41/0442 | D9/503 |
| 4,618,515 | A * | 10/1986 | Collette | B65D 1/0223 | 215/383 |
| 6,349,839 | B1 * | 2/2002 | Mooney | B65D 23/102 | 215/382 |
| 6,814,923 | B2 * | 11/2004 | Bromley | B29C 49/74 | 264/537 |
| 2004/0146672 | A1 * | 7/2004 | Lynch | B29C 57/045 | 264/537 |
| 2007/0045216 | A1 | 3/2007 | Gami et al. | | |
| 2017/0190473 | A1 * | 7/2017 | Garcia | B65D 1/0246 | |
| 2017/0210503 | A1 * | 7/2017 | de Cleir | B65D 1/0223 | |
| 2017/0305646 | A1 * | 10/2017 | Bacon | G01F 22/00 | |
| 2018/0244421 | A1 * | 8/2018 | Viale | B65D 41/348 | |
| 2018/0265241 | A1 * | 9/2018 | Taruno | B67B 3/22 | |
| 2018/0327130 | A1 * | 11/2018 | Taruno | B65D 1/023 | |

* cited by examiner

BOTTLE WITH A CUT MOUTH

OBJECT OF THE INVENTION

As established by the title above, the object of the present invention relates to a bottle or container with a cut mouth or a bottle devoid of a collar or ring, that is, it refers to a bottle without a mouth collar, whereby being called a cut mouth.

Throughout the description, when referencing the bottle it shall mean any container or recipient preferably made of glass having a storage area or body and a neck of the container through which the fluid stored inside the body of the bottle or container is supplied.

The present invention is characterised by the special configuration and design of the bottle which shows a handicraft appearance as it is devoid of a collar or ring, while the possibility of its automated manufacture is not limited.

Therefore, the present invention is comprised in the field of bottles and their morphology.

BACKGROUND OF THE INVENTION

In the state of the art, any bottle manufactured in an industrial process requires a mouth collar (also called finish or ring), which is essential in automation processes. Up until now, industrial bottles have never been manufactured without a ring, finish or mouth collar. As a result, there are an infinite number of ring designs and shapes: single, double, smooth, rounded, flush, threaded.

However, if the ring is to be eliminated and a bottle morphology with a cut mouth or without a mouth collar is to be obtained, and furthermore it is desired for them to be manufactured in an automated manner, means by way of a grip or overhang must be arranged whereby allowing them to be held and/or conveyed, both of which are essential actions in automated industrial processes (travelling from the starting mould to the finisher, the positioning in the finishing mould, removal of the bottle from the finishing mould, etc.).

Therefore, an object of the present invention is to develop a bottle or container devoid of a ring or mouth collar, which furthermore allows for being manufactured in an industrial and automated manner, developing a bottle such as the one described below and referred to in claim 1.

DESCRIPTION OF THE INVENTION

The object of the present invention relates to a bottle or a container with a cut mouth which can be conveyed or held in automated industrial processes, having at least one groove or recess arranged at the inflection point between the body of the bottle and the neck thereof.

The at least one groove is preferably a groove with a concave cross-section with curved profiles running along the perimeter and at one and the same level in the neck of the bottle or container and at the inflection point between the body of the bottle and the neck.

Given that the groove is a neck segment having a small width or cross-dimension, between 2 and 7 mm, preferably between 3 mm and 6 mm, and is combined with an unusually long mouth, it produces the visual effect of a bottle with a mouth and neck that are one-piece (without a collar), similar to the morphology of handicraft bottles or bottles with cut mouths.

In other words, the groove is an annular concavity at the base of the neck, at the inflection point between the body of the bottle and the neck thereof. This annular collar has a diameter slightly smaller than the diameter of the neck and coincides with the separation (parting line) from the mould of the bottle body and the part from the starting mould referred to in the industry as the "mouth cap", which is the upper part of the mould configuring the shape of the mouth. This circumstance means that the same bottle body can be combined with different mouth caps, giving rise to bottles that the consumer will identify as different. That is, in addition to obtaining a cut mouth effect, the groove allows different bottles to be manufactured by just changing the mouth cap (upper attachment of the starting mould).

Derived from the preceding characteristics, a new paradigm is generated in the glass industry which, up until now, used the change of the mouth cap for functional purposes. An ultra-long mouth cap is contemplated, said cap reaches the shoulder (to the annular groove) and allows configuring, by just changing the upper cap, a general silhouette that is different in shape and height, which can furthermore be manufactured on an industrial level and is devoid of a ring or retaining part at the final end of the bottle.

That is, the mould of the neck can be changed without changing the moulds of the body, even if they had a ring, that is, bottles with upper parts with necks and mouths with a ring.

The annular groove could furthermore also serve for fixing automatic closure caps.

The finishing of the cut mouth can be straight as a result of the cutting made or it can be bevelled.

Except when indicated otherwise, all of the technical and scientific elements used in this specification have the meaning commonly understood by a person with average skill in the art to which this invention belongs. When this invention is put into practice, methods and materials may be used that are similar or equivalent to the ones described in the specification.

Throughout the description and the claims the word "comprises" and its variants do not intend to exclude other technical features, additives, components or steps. For those skilled in the art, other objects, advantages and features of the invention will be deduced from both the description and the practical use of the invention.

DESCRIPTION OF THE FIGURES

As a complement to the description provided herein, and for the purpose of helping to make the features of the invention more readily understandable, in accordance with a preferred practical exemplary embodiment thereof, said description is accompanied by a set of drawings which, by way of illustration and not limitation, represent the following.

PREFERRED EMBODIMENT OF THE INVENTION

In light of the figures, a preferred embodiment of the proposed invention is described below.

Figure 1:
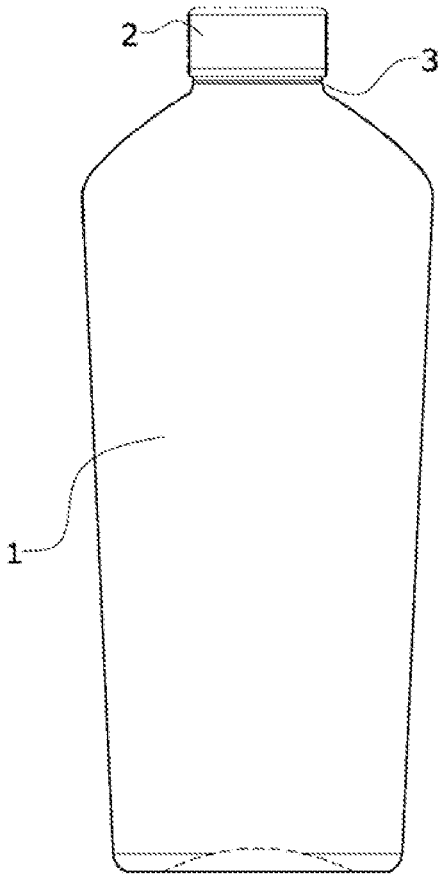
FIG. 1 depicts a front view of a bottle as the object of the invention.

A bottle having a bottle body (1), a bottle neck (2) emerging from the upper part of the bottle body (1) having a cut mouth or a mouth without a ring can be observed in FIG. 1.

At the inflection point of the attachment between the body (1) of the bottle and the neck (2) of the bottle, there is an annular groove (3).

Said annular groove (3), preferably has, but in a non-limiting manner, a curved cross-section forming a concavity, although any other geometry for the cross-section of the annular groove (3), such as rectangular, trapezoidal, polygonal, concave-curved, etc., cannot be ruled out.

Figure 4:
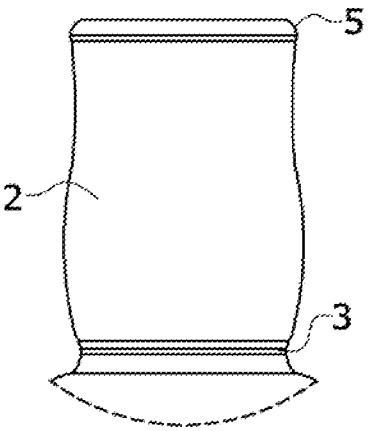
FIGS. 2 to 4 show different bottle necks with a cut mouth, the bases of which have an annular groove.
Figure 3:
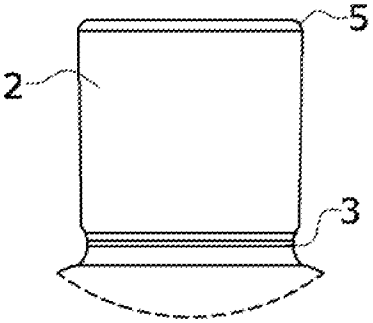
Figure 2:
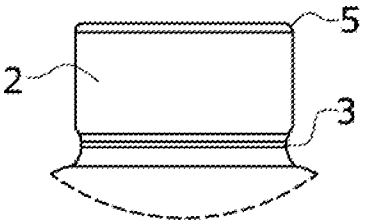

FIGS. 2, 3 and 4 show different bottle necks (2) which at the lower end have an annular groove (3), showing that the upper end of the bottle neck (2) has a cut mouth, in the embodiments shown the mouth is finished with an oblique or bevelled cut (5).

Figure 5:
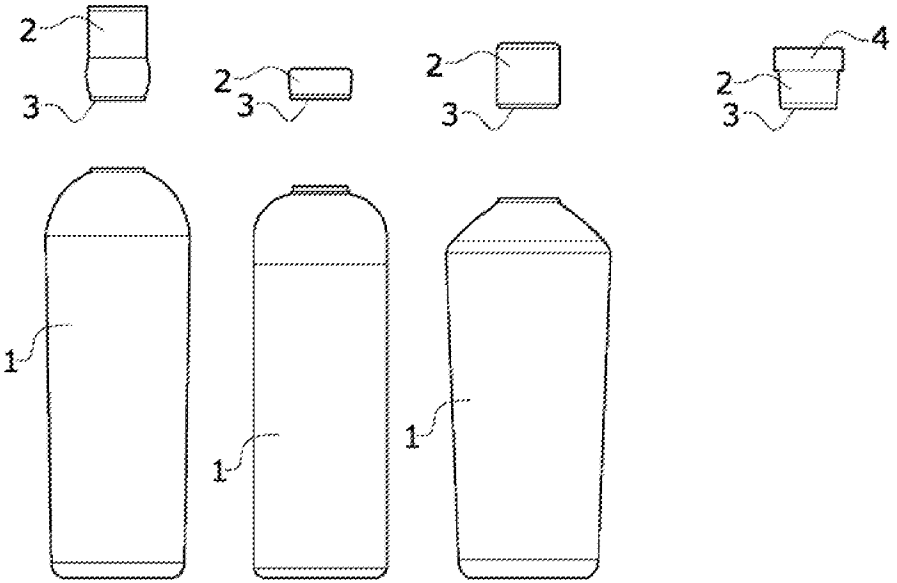
FIG. 5 shows the possibilities offered by being able to combine different bottle necks with different bottles bodies.
Figure 5:
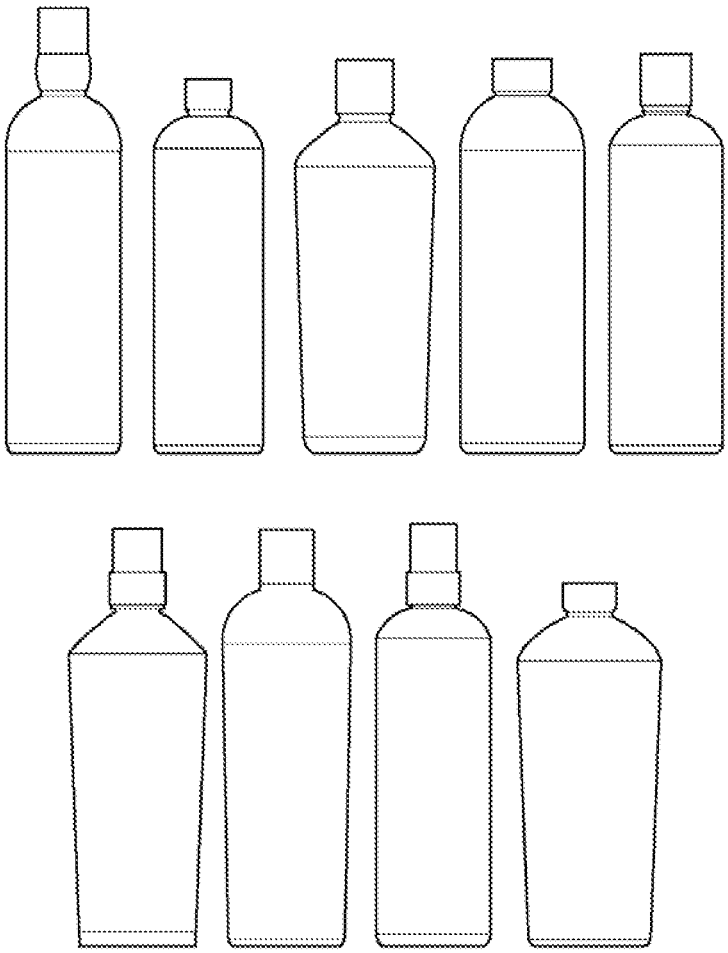

The different morphologies of bottle necks (2) and their combination with the different morphologies of the bodies (1) of the bottles offer a number of combinations, as shown in FIG. 5, where a bottle neck (2) is furthermore observed, which has, in addition to the annular groove (3), a ring (4), that is, the presence of an annular groove does not limit the possibility of even having a ring (4).

Having thus adequately described the nature of the present invention, as well as how to put it into practice, it must be noted that, within its essential nature, the invention may be carried out according to other embodiments differing in detail from that set out by way of example, which the protection sought would equally cover, provided that the fundamental principle thereof is not altered, changed or modified.

The invention claimed is:

1. A bottle or container with a cut mouth or a bottle neck without a collar ring comprising, a bottle body, a bottle neck emerging from an upper part of the bottle body, wherein the bottle neck has a cut mouth or without a collar ring, at an inflection point being defined by a curvature between the upper part of the bottle body and the bottle neck, wherein there is at least one annular groove positioned within the curvature and wherein the entire bottle neck has a continuous surface without any protrusion or groove.

2. The bottle or container with a cut mouth or a bottle neck without a collar ring according to claim 1, wherein the annular groove has a curved cross-section forming a concavity.

3. The bottle or container with a cut mouth or a bottle neck without a collar ring according to claim 1, wherein the annular groove has a width or cross-section between 2 mm and 7 mm.

4. The bottle or container with a cut mouth or a bottle neck without a collar ring according to claim 1, wherein the cut mouth is finished by means of an oblique or bevelled cut.

5. The bottle or container with a cut mouth or a bottle neck without a collar ring according to claim 1 the bottle or container with a cut mouth or a bottle neck without a collar ring is made of glass.

* * * * *